US006354201B1

(12) United States Patent
Ishitoya

(10) Patent No.: US 6,354,201 B1
(45) Date of Patent: Mar. 12, 2002

(54) STENCIL PRINTER

(75) Inventor: Mitsuaki Ishitoya, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/503,703

(22) Filed: Feb. 14, 2000

(30) Foreign Application Priority Data

Feb. 12, 1999 (JP) ..... 11-033923

(51) Int. Cl.[7] ..... B41C 1/14
(52) U.S. Cl. ..... 101/128.4
(58) Field of Search ..... 101/114, 116, 101/128.21, 128.4

(56) References Cited

U.S. PATENT DOCUMENTS 4,579,810 A * 4/1986 Johnson et al. ..... 430/293
5,517,913 A * 5/1996 Oshio et al. ..... 101/119
5,689,297 A 11/1997 Yokoyama et al.
5,748,858 A * 5/1998 Ohtsuka et al. ..... 395/109

FOREIGN PATENT DOCUMENTS

JP 7-52515 * 2/1995

* cited by examiner

*Primary Examiner*—Ren Yan
(74) *Attorney, Agent, or Firm*—Nixon Peabody LLP; Donald R. Studebaker

(57) ABSTRACT

Dot-gain information representative of the dot gain of ink is input for each ink type to be used in printing by a dot-gain information input section (80), and spectral-density information representative of the spectral density of the ink is input by a spectral-density information input section (82). Based on the input dot-gain information and spectral-density information, a perforation-size control section (84) outputs a heating signal (ENS) and a voltage control signal (S) so that the size of a perforation becomes a predetermined printing dot size at all times.

15 Claims, 7 Drawing Sheets

STENCIL PRINTER

BACKGROUND OF THE INVENTION

1. Field of the Invention

The present invention relates to a color stencil printer, and more particularly to an improvement in printing quality resulting from a difference in the dot gain of ink, particularly a variation in hue.

2. Description of the Related Art

A printer, such as a thermal printer, a copying machine, a stencil printer and the like are known as an image forming apparatus which outputs the same image as a read image to printing paper or the like, based on an original image signal read by a reading section having a charge-coupled device (CCD) line sensor or the like.

In the above-mentioned stencil printer, a stencil making section, consisting of a thermal head and a platen roller, perforates a stencil paper, based on an original image signal read by the reading section. Then, the perforated stencil paper is wound around a printing drum. Next, printing paper is inserted between the printing drum and a press roller which rotates in contact with the printing drum. Ink inside the printing drum is pushed out to the printing paper through the perforations in the perforated stencil paper, whereby ink transfer is performed. In this way, printing is performed.

With recent advances in image coloring, color stencil printers have been proposed which make a perforated stencil paper using a thermal head for each color to be used in printing and perform color printing by performing overprinting, using the perforated stencil paper for each color.

When color printing is performed with the color stencil printer, enhancing image gradation or printing in a desired tone of color is very important in order to enhance the quality of a printed image. For that purpose, gradation and color-tone controls are indispensable. To perform these controls, scanner γ-correction, color-tone control, printer γ-correction, gradation control and the like have hitherto been performed.

As a method of embodying gradation control in this color processing, a method of controlling printing for each color by various kinds of image processing, such as half tone processing (such as a dithering method and an error diffusing method) and the like, is common. Also, as a method of embodying color-tone control, it is common to convert a read color image to an arbitrary color space and then adjust the image so that it has a desired tone of color on the color space.

In such methods of embodying gradation control and color-tone control, control is performed on the assumption that the dot gains of inks to be used in printing are all the same. The "dot gain" used herein means a ratio of the size of ink, transferred onto a printing paper through a perforation formed in a stencil paper, to the size of the perforation.

The control is also performed on the assumption that ink to be used is ideal ink in which the spectral density, as shown in FIG. 7, includes only the spectral component of a necessary color for each color and does not include an unnecessary spectral component. Furthermore, the control is performed on the assumption that, if inks differ in ink type but are the same in color, the spectral densities are also the same.

However, the dot gains of inks that are actually used are not always the same. If inks differ in color, the dot gains thereof will differ, and even if inks are the same in color but if inks differ in ink type, the dot gains will differ. For this reason, if printing is performed with inks differing in dot gain by a single thermal head, there is a problem that desired printing quality will not be obtained, even if the above-mentioned gradation or color-tone control were performed. For instance, a magenta color becomes lighter as a whole than a cyan color. If overprinting is performed, a bluish image will be obtained, or it will be reversed. Thus, a desired tone of color cannot be brought out.

As primary factors having influence on the dot gain of ink, the following are considered. What is expressed to be greater by a sign of inequality is that the dot gain of ink is greater.

(1) Ink, a Master Fiber, and Paper

Ink viscosity: soft>hard

Master fiber: Japanese paper>chemical fiber

Surface roughness of paper: RISO paper>fine paper (RISO SR paper)>simple coated paper (inkjet paper) >rough dyed paper (smoother than inkjet paper) >perfect coated paper The "RISO paper" and "RISO SR paper" here means printing paper made by RISO KAGAKU Corporation.

(2) Control Information

Platen pressure: strong>weak

Pressure-applying time: long>short

Printing speed: slow>fast (3) Others

Temperature: high>low

In addition, the spectral density of each ink to be actually used includes not only the spectral component of a necessary color but also unnecessary spectral absorption called auxiliary absorption. For example, yellow ink absorbs not only a Blue component but also components other than the Blue component. Therefore, each ink that is actually used has spectral density such as that shown in FIG. 8. For that reason, in mixing colors, the inks will become too deep because a certain spectral density is polarized. Therefore, even if the dot gains of all inks are the same, a problem that desired printing quality (tone of color) will not be obtained will arise. Furthermore, there are cases where even if inks are the same color, the spectral densities will differ if the inks differ in ink type. For that reason, even if perforation sizes are the same, a problem will arise that the spectral densities of inks will differ if the inks differ in ink type.

SUMMARY OF THE INVENTION

In view of the foregoing observations and description, the primary object of the present invention is to provide a color stencil printer which is capable of obtaining desired printing quality even when the dot gains of inks to be used in printing differ or even when the spectral densities of the inks are not ideal.

To achieve the above object and in accordance with the present invention, there is provided a color stencil printer comprising stencil making means which perforates a heat-sensitive stencil paper using a thermal head, based on input binary image data, and printing means which performs printing by transferring ink to printing paper through a perforation of the perforated stencil paper, wherein the stencil making means includes dot-gain information input means which inputs dot-gain information representative of a dot gain of ink for each ink type to be used in the printing and/or spectral-density information input means which inputs spectral-density information representative of the spectral density of the ink, and perforation-size control means which controls the size of the perforation, based on the dot-gain information and/or the spectral-density information.

In a preferred form of the present invention, the perforation-size control means performs gradation control and/or color-tone control by controlling the size of the perforation.

In the color stencil printer according to the present invention, the binary image data may be data on which half tone processing has been performed.

According to the stencil printer of the present invention, the size of the perforation is controlled for each ink type to be used in printing, based on the dot gain and spectral density of the ink. Therefore, even if the dot gains of inks differ, or even if the spectral densities of the inks are not ideal, the perforation can be formed into a suitable printing dot size in consideration of the dot gain and spectral density of ink to be actually used.

In addition, the perforation size is controlled to control printing dot size. By controlling this perforation size, it becomes possible to perform gradation control and/or color-tone control. Although the color processing in the conventional stencil printer requires image processing such as scanner γ-correction, color-tone control, printer γ-correction, gradation processing and the like, the stencil printer of the present invention renders simple and free color adjustments possible. Furthermore, since the perforation size is controlled for each ink type in consideration of the dot gain and spectral density of the ink, printing can always be performed in a predetermined printing dot size, even if inks differ in ink type.

DESCRIPTION OF THE PREFERRED EMBODIMENTS

A preferred embodiment of a color stencil printer according to the present invention will hereinafter be described in detail with reference to the drawings.

Figure 1:
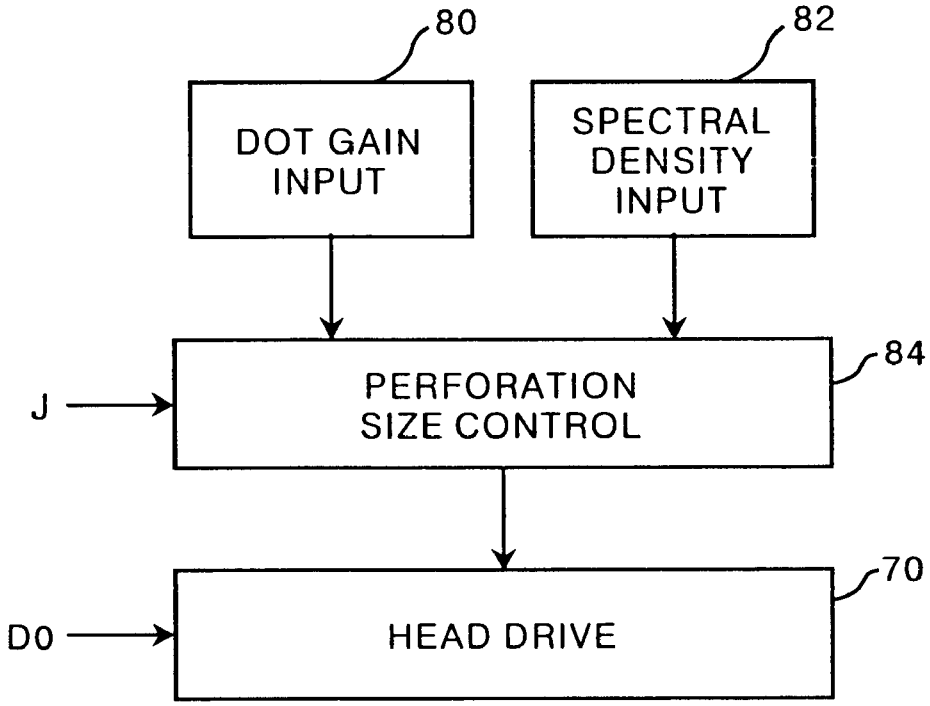
FIG. 1 is a block diagram showing the stencil making section of a color stencil printer constructed according to the present invention.

As shown in FIG. 1, the stencil making section of the color stencil printer comprises (1) head drive means 70 which drives each heating element 90 constituting a thermal head, based on input binary image data D0, (2) dot-gain information input means 80 which inputs dot-gain information representative of the dot gain of ink for each ink type to be used in printing, (3) spectral-density information input means 82 which inputs spectral-density information representative of the spectral density of the ink, and (4) perforation-size control means 84 which is connected to the head drive means 70 and controls the size of a perforation formed in a stencil paper 23 inserted between the thermal head and a platen roller 33, based on the input dot-gain information and spectral-density information.

Figure 2:
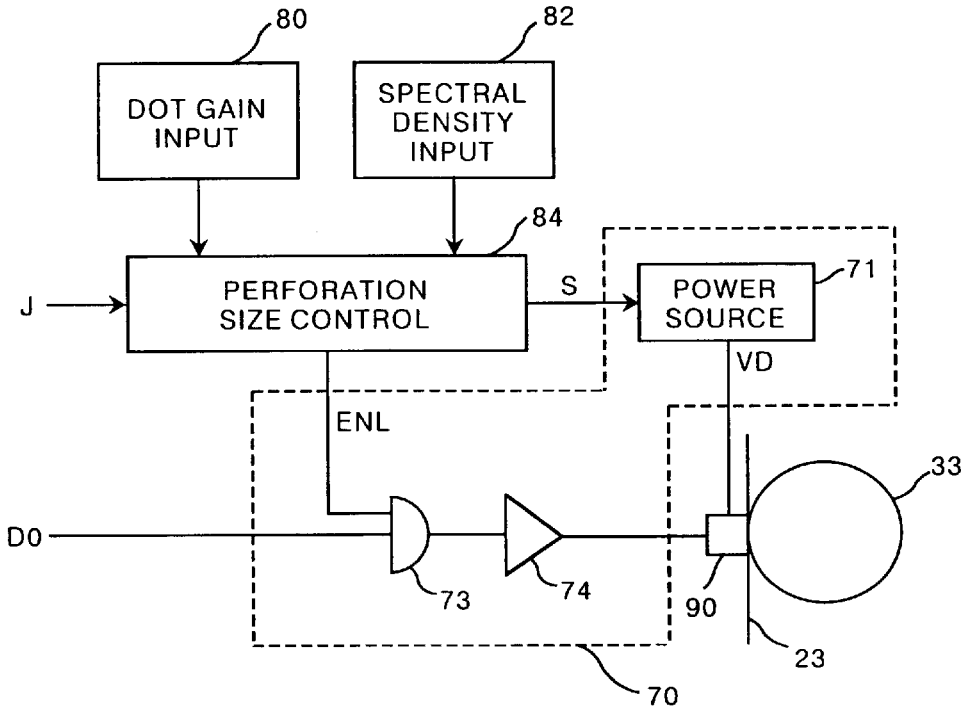
FIG. 2 is a block diagram showing the head drive means of the stencil making section shown in FIG. 1.

FIG. 2 shows the construction of the head drive means 70 in greater detail. As shown in the figure, the perforation-size control means 84 outputs a heating signal ENL and a voltage control signal S to the head drive means 70. The heating signal ENL prescribes a heating time for the heating element 90, while the voltage control signal S controls the output voltage VD of a power source 71.

The head drive means 70 comprises the power source 71 for the heating element 90 constituting the thermal head, an AND gate 73 which performs the logic AND operation between the input binary image D0 and heating signal ENL, and a buffer 74 which transmits this gate output to the thermal head. The binary image data D0 is input as serial data and converted to parallel data by shift registers (not shown). The parallel data is input to the AND gate 73. With the logic AND operation between the binary image D0 and the heating signal ENL which is issued at desired timing, each heating element 90 constituting the thermal head is turned on and heated at the desired timing. In performing one perforation for one pixel, a predetermined voltage VD is continuously applied from the power source 71 to each heating element 90 over a fixed time, based on the heating signal ENL. Therefore, the size of the perforation which is formed in the stencil paper 23 varies according to the applied voltage VD and the heating time. Information J representative of the type of binary image data D0, such as information indicating normal data, information indicating half tone processing has been performed on the data, information indicating what kind of half tone processing has been performed on the data, is input to the perforation-size control means 84. The perforation-size control means 84 controls the applied voltage VD and the heating time so that a perforation is formed into a predetermined size corresponding to the type of the binary image data D0.

Now, the operation of the stencil printer with the aforementioned construction will be described.

The dot-gain information representative of the dot gain of ink is input for each ink type to be used in printing by the dot-gain information input means 80. Similarly, the spectral-density information representative of the spectral density of the ink is input by the spectral-density information input means 82. The input dot-gain information and spectral-density information are temporarily stored in memory (not shown). Note that when there are a plurality of ink types, it is preferable that the information be stored for each ink type.

Figure 7:
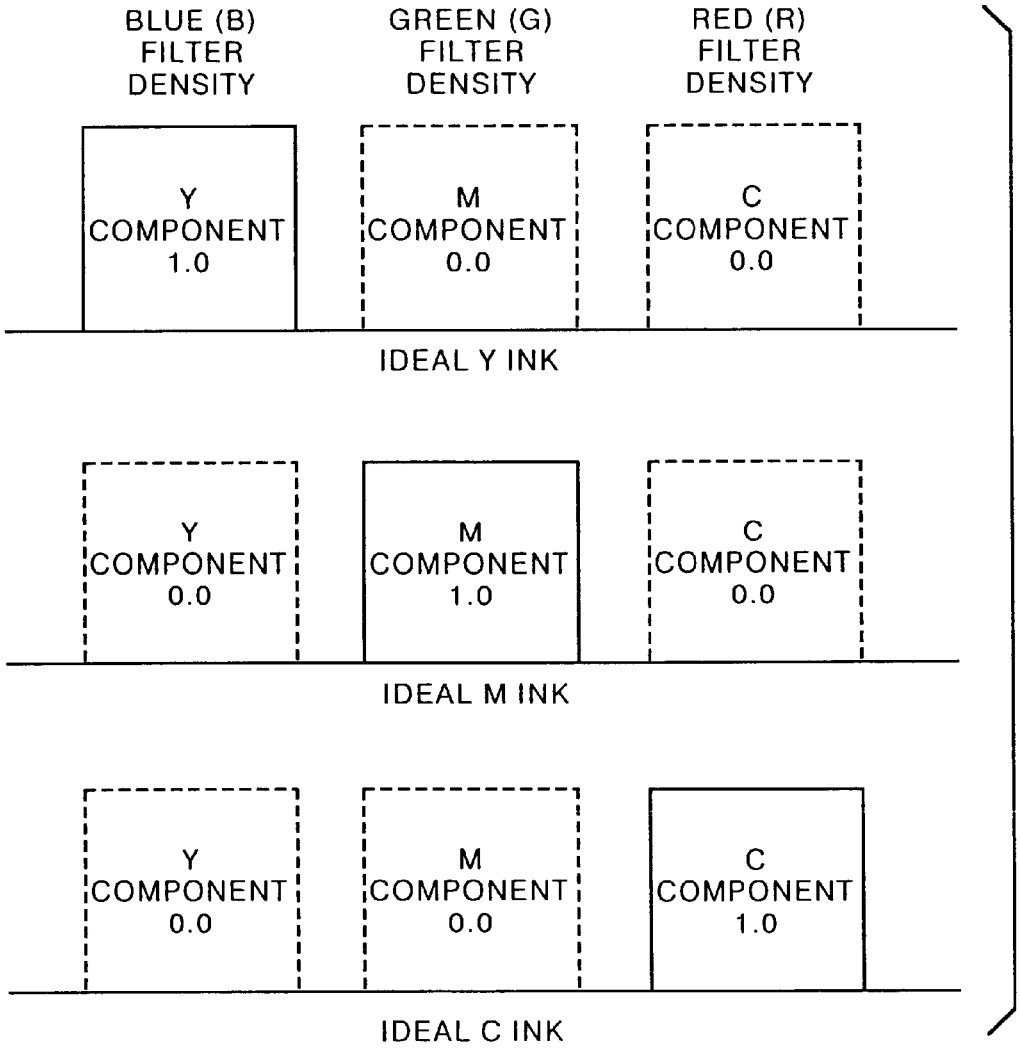
FIG. 7 is a diagram showing the spectral density of ideal ink.
Figure 8:
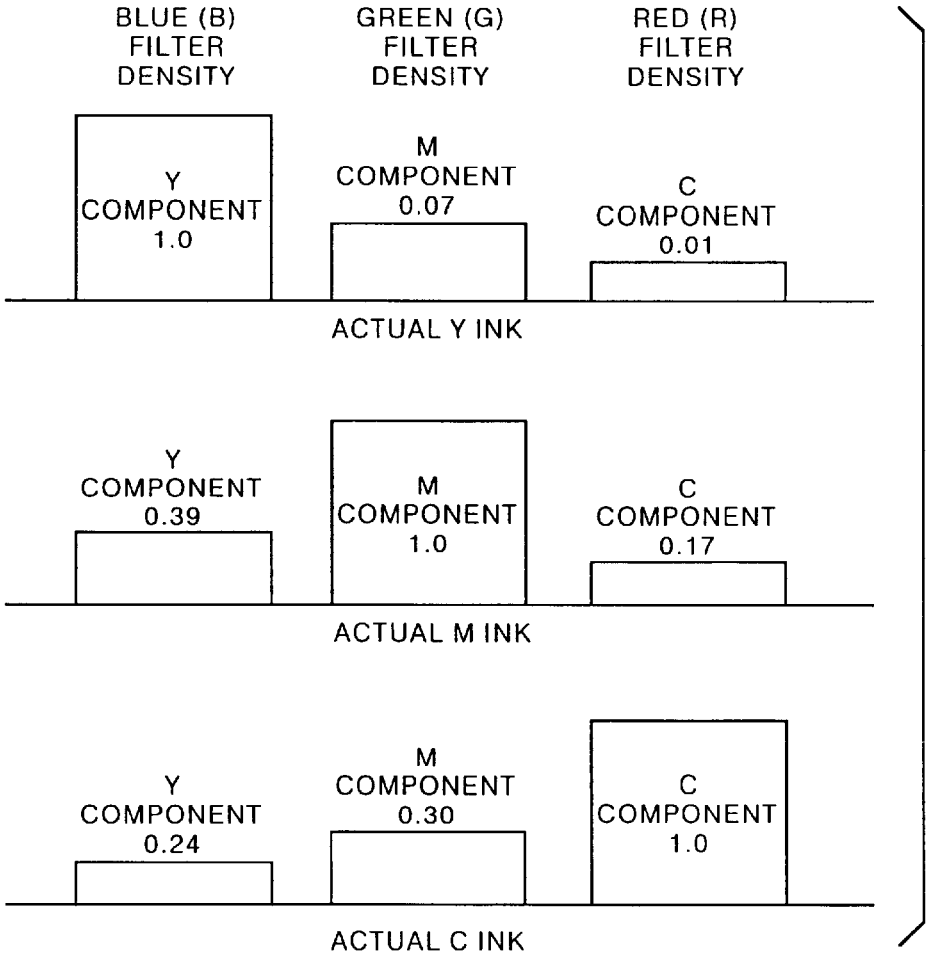
FIG. 8 is a diagram showing the spectral density of actual ink.

The inks used in printing have three colors, yellow (Y), cyan (C), and magenta (M), respectively. Also, assume that the spectral densities of the three color inks are ideal as shown in FIG. 7.

Since the stencil paper 23 is formed for each color, the binary image data D0 is also input for each color. For example, data is extracted for each color by a scanner (not shown), whereby image data is generated for each color.

Based on the information J representative of the type of the input image data D0, the perforation-size control means 84 outputs the heating signal ENL corresponding to the dot gain of each ink and the voltage control signal S so that the printing dot size of each ink becomes a printing dot size corresponding to the information J. In forming a perforation in the stencil paper 23, the perforation-size control means 84 drives the heating element 90 in accordance with the heating time and the applied voltage VD, taking the dot gain of each ink into consideration so that the printing dot size of the ink becomes a printing dot size corresponding to the information J.

Unless the dot gain of ink is taken into consideration, hue degradation will occur due to a variation in the dot gain and auxiliary absorption. However, in the stencil printer according to the present invention, control is performed so that printing dot size becomes a predetermined size. Therefore, hue degradation is improved. Note that while it has been described that the heating time and the applied voltage VD are both set in consideration of the dot gain or spectral density, either only one or the other of the two may be set in consideration of the dot gain or spectral density.

It has also been described that in consideration of the dot gain of ink, the perforation size is controlled so that printing dot size becomes a predetermined size. However, when the spectral density of each ink to be used in printing is not an ideal one shown in FIG. 7, the perforation size may be controlled, in consideration of the spectral density of ink input by the spectral-density information input means 82, so that the hue of printed matter becomes a desired one.

In addition, in the stencil printer according to the present invention, in consideration of the dot gain or spectral density of ink for each ink type, the heating time and the applied voltage VD are controlled in order to control the perforation size, and in addition to this, it is possible to control the perforation size so that it becomes a printing dot size corresponding to gradation control or color-tone control. A description will hereinafter be given with regard to the case of performing gradation control or color-tone control.

Figure 3:
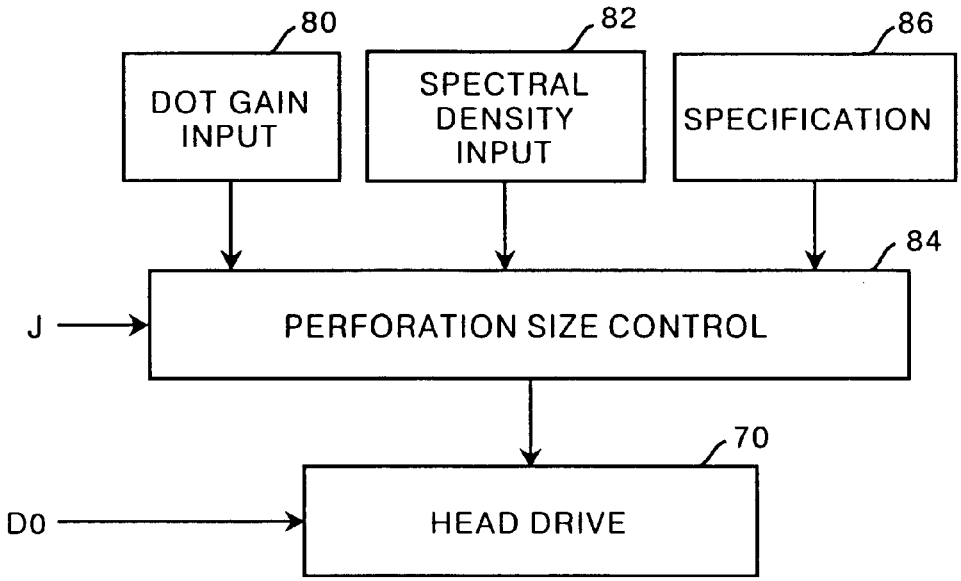
FIG. 3 is a block diagram showing another example of the stencil making section shown in FIG. 1.

FIG. 3 shows the stencil making section of a stencil printer which performs gradation control or color-tone control. As shown in the figure, specification means 86 for specifying gradation or a color tone is connected to perforation-size control means 84.

Figure 4:
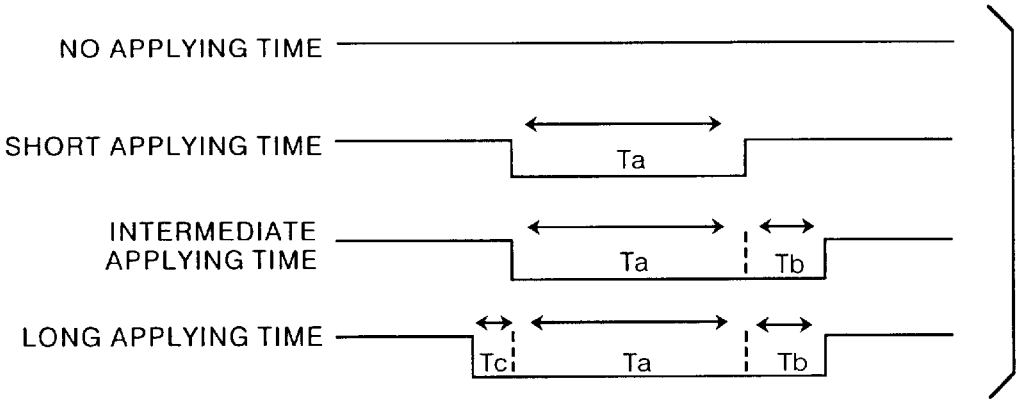
FIG. 4 is a diagram showing pattern examples for a heating signal.

FIG. 4 shows pattern examples for the heating signal ENL which controls the heating time (i.e., the time during which voltage is applied to the heating element 90*a*) in performing gradation control or color-tone control. In FIG. 4 there are shown 4 patterns, "no applying time", "short applying time", "intermediate applying time", and "long applying time". The perforation-size control means 84 selects one of these patterns for each color in accordance with gradation or a color tone specified by the specification means 86 and controls the size of a perforation.

Figure 5:
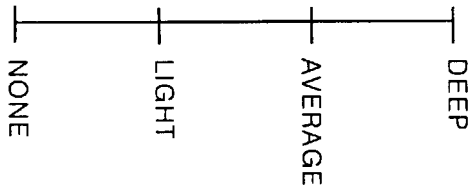
FIG. 5 is a diagram showing an example of density expression corresponding to the pattern of the heating signal.

FIG. 5 shows 4-level density expression corresponding to the 4 patterns of the heating signal ENL shown in FIG. 4. "None" in the density expression corresponds to the "no applying time" of the 4 patterns, "light" to the "short applying time", "average" to the "intermediate applying time", and "deep" to the "long applying time". Note that this density expression may be set arbitrarily.

Figure 6:
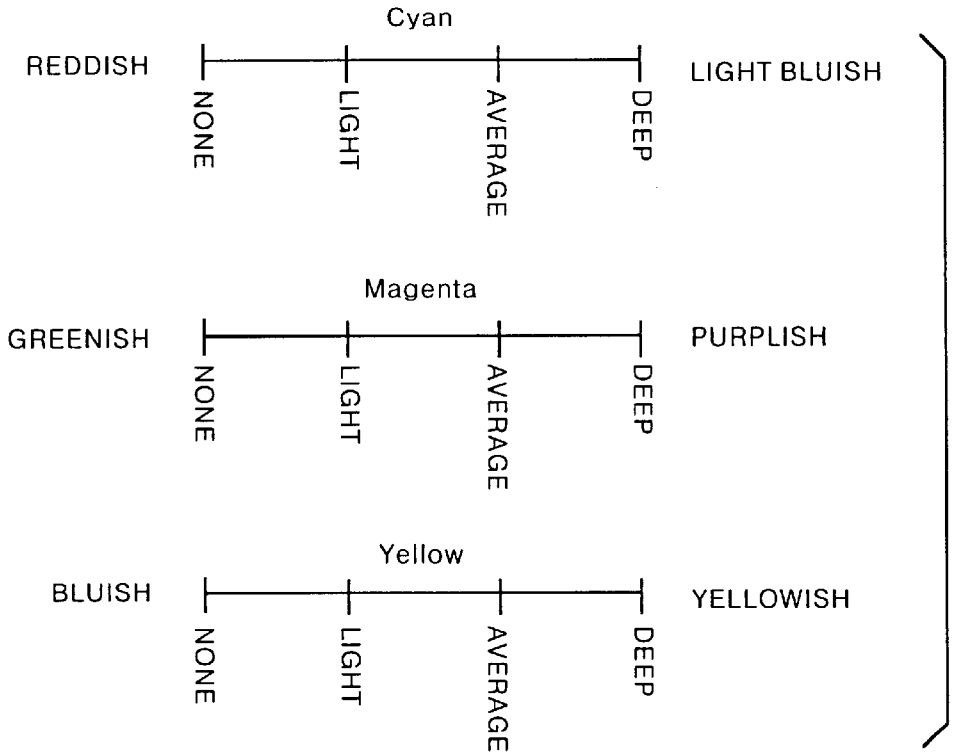
FIG. 6 is a diagram showing variations in the color tone of a printed color corresponding to the density expression.

For cyan, magenta, and yellow which are actually printed, variations in the hue of each printed color corresponding to the above-mentioned density expression are shown in FIG. 6. For instance, if cyan is set to "none", a reddish hue is obtained as a whole, and if it is set to "deep", a light bluish hue is obtained as a whole. Also, if magenta is set to "none", a greenish hue occurs as a whole, and if it is set to "deep", a purplish hue occurs as a whole. Likewise, yellow set to "none" results in a bluish hue, and if set to "deep", a yellowish hue occurs as a whole. If cyan, magenta, and yellow are further combined with one another, it becomes possible to obtain various hues freely and therefore color-tone control becomes possible. The conventional color processing requires image processing such as scanner γ-correction, color correction, printer γ-correction, gradation processing and the like, whereas the stencil printer of the present invention is able to make simple and free color adjustments, because the color-tone control is performed by controlling the size of a perforation and, as described above, phased-color expression can be used in performing color-tone control. In addition, in performing this color-tone control, the perforation size is controlled for each ink type in consideration of the dot gain or spectral density of ink. Therefore, printing can always be performed in a predetermined printing dot size without regard to ink types, and consequently, a desired color tone can be obtained at all times.

While it has been described that in the above-mentioned color-tone control, the size of a perforation , i.e., printing dot size is controlled by controlling the heating time, the present invention is not limited to this control, but it is a matter of course that printing dot size may be controlled by controlling voltage VD which is applied to the heating element.

Furthermore, although the color-tone control has been described, it is a matter of course that the present invention is also applicable to mono-tone gradation control in the same manner. It is also a matter of course that half tone control can be performed by taking advantage of this gradation control.

In the stencil printer according to the present invention, binary image data that is input may be data on which half tone processing has been performed. As shown in FIG. 2, information J representative of the type of the binary image data D0 is input to the perforation-size control means 84, and the perforation-size control means 84, as with the control signal generation means in the conventional stencil printer, controls the applied voltage VD and the heating time so that a perforation is formed into a predetermined size corresponding to the type of half tone processing such as an error diffusing method and a dithering method. In performing this control, for example, if the heating time and the applied voltage VD are controlled for each ink type in consideration of the dot gain or spectral density of ink, as described above, the perforating size can be controlled so that it becomes a desired printing dot size.

What is claimed is:

1. A stencil printer comprising stencil making means which perforates a heat-sensitive stencil paper using a thermal head, based on input binary image data, and printing means which performs printing by transferring ink to printing paper through a perforation of the perforated stencil paper, wherein the stencil making means includes dot-gain information input means which inputs dot-gain information representative of a dot gain of ink for each ink type to be used in the printing, spectral-density information input means which inputs spectral-density information representative of spectral density of the ink, and perforation-size control means which controls the size of the perforation, based on the dot-gain information and the spectral-density information.

2. The stencil printer as defined in claim 1 in which the perforation-size control means performs gradation control and color-tone control by controlling the size of the perforation.

3. The stencil printer as defined in claim 1 in which the perforation-size control means performs gradation control by controlling the size of the perforation.

4. The stencil printer as defined in claim 1 in which the perforation-size control means performs color-tone control by controlling the size of the perforation.

5. The stencil printer as defined in claim 1 in which the binary image data is data on which half tone processing has been performed.

6. A stencil printer comprising stencil making means which perforates a heat-sensitive stencil paper using a thermal head, based on input binary image data, and printing means which performs printing by transferring ink to printing paper through a perforation of the perforated stencil paper, wherein the stencil making means includes dot-gain information input means which inputs dot-gain information representative of a dot gain of ink for each ink type to be used in the printing, and perforation-size control means which controls the size of the perforation, based on the dot-gain information.

7. The stencil printer as defined in claim 6 in which the perforation-size control means performs gradation control and color-tone control by controlling the size of the perforation.

8. The stencil printer as defined in claim 6 in which the perforation-size control means performs gradation control by controlling the size of the perforation.

9. The stencil printer as defined in claim 6 in which the perforation-size control means performs color-tone control by controlling the size of the perforation.

10. The stencil printer as defined in claim 6 in which the binary image data is data on which half tone processing has been performed.

11. A stencil printer comprising stencil making means which perforates a heat-sensitive stencil paper using a thermal head, based on input binary image data, and printing means which performs printing by transferring ink to printing paper through a perforation of the perforated stencil paper, wherein the stencil making means includes spectral-density information input means which inputs spectral-density information representative of spectral density of the ink, and perforation-size control means which controls the size of the perforation, based on the spectral-density information.

12. The stencil printer as defined in claim 11 in which the perforation-size control means performs gradation control and color-tone control by controlling the size of the perforation.

13. The stencil printer as defined in claim 11 in which the perforation-size control means performs gradation control by controlling the size of the perforation.

14. The stencil printer as defined in claim 11 in which the perforation-size control means performs color-tone control by controlling the size of the perforation.

15. The stencil printer as defined in claim 11 in which the binary image data is data on which half tone processing has been performed.

* * * * *